US007690386B2

(12) United States Patent
Sinclair, Jr. et al.

(10) Patent No.: US 7,690,386 B2
(45) Date of Patent: Apr. 6, 2010

(54) INTERMEDIATE WRAPPER AND METHOD OF MAKING

(75) Inventors: Daniel S. Sinclair, Jr., Mandeville, LA (US); Philip S. Zanghi, III, El Segundo, CA (US)

(73) Assignee: Blunt Wrap U.S.A., Inc., Mandeville, LA (US)

( * ) Notice: Subject to any disclaimer, the term of this patent is extended or adjusted under 35 U.S.C. 154(b) by 156 days.

(21) Appl. No.: 12/164,248

(22) Filed: Jun. 30, 2008

(65) Prior Publication Data

US 2008/0257366 A1 Oct. 23, 2008

Related U.S. Application Data

(62) Division of application No. 11/085,822, filed on Mar. 21, 2005, now Pat. No. 7,543,590.

(60) Provisional application No. 60/584,230, filed on Jun. 30, 2004.

(51) Int. Cl.
*A24C 5/32* (2006.01)
*A24C 5/34* (2006.01)

(52) U.S. Cl. ..... 131/280; 131/347; 131/365; 131/360; 131/73; 131/77; 206/242

(58) Field of Classification Search ..... None
See application file for complete search history.

(56) References Cited

U.S. PATENT DOCUMENTS 191,501 A 5/1877 Willis
200,889 A 3/1878 Bishop
304,582 A 9/1884 Thoss
389,975 A 9/1888 Riedel
657,403 A 9/1900 Du Brul
663,073 A 12/1900 Coughtry (Continued)

FOREIGN PATENT DOCUMENTS

DE 352277 4/1922

(Continued)

OTHER PUBLICATIONS

Declaration of Daniel S. Sinclair, Jr. dated Aug. 22, 2001 and Declaration of Daniel S. Sinclair, Jr. dated Oct. 19, 2001.

*Primary Examiner*—Philip C Tucker
*Assistant Examiner*—Phu H Nguyen
(74) *Attorney, Agent, or Firm*—Garvey, Smith, Nehrbass & North, L.L.C.; Brett A. North; Seth M. Nehrbass

(57) ABSTRACT

A tobacco product is formed by perforated cigar or shell, the shell comprising a sheet of material with an intermediate sheet, the sheet comprising tobacco leaves and/or homogenized tobacco paper. The cigar or shell is packaged for shipment to an end user or consumer. The cigar or shell remains in the rolled, shaped tube form inside the package. After the cigar or shell is removed from the package, a consumer can fill the cigar or shell with crushed tobacco leaves or other tobacco filler material of a favorite blend, thereby eliminating some steps in the making of a "roll-your-own" tobacco product. A liquid can be added to the cigar or shell to moisturize same. The liquid can include flavoring.

11 Claims, 7 Drawing Sheets

U.S. PATENT DOCUMENTS

| | | | | |
|---|---|---|---|---|
| 725,671 | A | 4/1903 | Butler | |
| 1,104,779 | A | 7/1914 | Cooley | |
| 1,223,362 | A | 4/1917 | Bock | |
| 3,385,302 | A | 5/1968 | Wattenford | |
| 3,580,433 | A | 5/1971 | Kastner | |
| 4,452,257 | A | 6/1984 | Cartwright et al. | |
| 4,726,473 | A * | 2/1988 | Sato et al. | 229/87.05 |
| 5,147,463 | A | 9/1992 | Eilerman et al. | |
| 5,645,089 | A | 7/1997 | Burger et al. | |
| 5,762,074 | A | 6/1998 | Garner | |
| 5,782,246 | A | 7/1998 | Axelrod | |
| 6,164,443 | A | 12/2000 | Mitchell et al. | |
| 6,321,755 | B1 | 11/2001 | Sinclair, Jr. | |
| 6,357,448 | B1 | 3/2002 | Sinclair, Jr. | |
| 6,526,986 | B1 | 3/2003 | Sinclair, Jr. | |
| 6,742,525 | B2 | 6/2004 | Sinclair, Jr. | |
| 6,854,471 | B1 | 2/2005 | Sinclair, Jr. | |
| 2002/0166561 | A1 * | 11/2002 | Sinclair, Jr. | 131/73 |

FOREIGN PATENT DOCUMENTS

| | | |
|---|---|---|
| GB | 1230576 | 5/1971 |

* cited by examiner

INTERMEDIATE WRAPPER AND METHOD OF MAKING

CROSS-REFERENCE TO RELATED APPLICATIONS

This application claims priority of U.S. patent application Ser. No. 60/584,230, filed 30 Jun. 2004.

U.S. patent application Ser. No. 60/584,230, filed 30 Jun. 2004, is hereby incorporated by reference.

This application is a divisional of U.S. patent application Ser. No. 11/085,822, (now U.S. Pat. No. 7,543,590), filed 21 Mar. 2005, which is hereby incorporated by reference.

STATEMENT REGARDING FEDERALLY SPONSORED RESEARCH OR DEVELOPMENT

Not applicable

REFERENCE TO A "MICROFICHE APPENDIX"

Not applicable

BACKGROUND

The present invention relates to tobacco products, and more particularly to a cigar or shell enabling an end user or consumer to prepare a custom cigar. The variety, quality and size of ready-made cigars satisfy the majority of the public. However, a small segment of connoisseurs insist that nothing can compare with the taste and smell of custom-blended tobacco products. These knowledgeable individuals are very selective in the manner their cigars are rolled and in the grade of tobacco used. A still smaller segment of cigar aficionados prefers to roll their own cigars. They buy tobacco leaves or cigar wrappings and use their preferred brand of crushed tobacco. Some people buy inexpensive cigars, cut them with a sharp blade along the side, and carefully pry the cut cigar open. The innermost layers are then removed and substituted with a favorite brand of crushed tobacco, which may come from cigarettes or bulk tobacco blend. The user then brings the cut edges of the cigar together, closing the outer layers of the cigar over the "stuffing." The edges are then sealed with a liquid or honey, and a new cigar is ready for smoking.

Some reports indicate that the roll-your-own tobacco market is flourishing. In some countries, the roll-your-own products now hold a substantial share of the tobacco market, and their consumers represent more than 10% of the smoking population. This maybe explained by the ability of a consumer to create a tailor-made product, as opposed to commercially available types of cigars.

A disadvantage of the existing method of making such custom-made cigars is that a consumer has to be skillful in the rolling of cigars, that is to have a certain finger dexterity, which would allow him to make the cigar shell without crushing the tobacco leaves. Inexperienced people often become frustrated when the finished product collapses because the cigar was not properly rolled.

One disadvantage of existing roll your own tobacco sheets is a relatively short shelf life based on the loss of moisture.

While certain novel features of this invention shown and described below are pointed out in the annexed claims, the invention is not intended to be limited to the details specified, since a person of ordinary skill in the relevant art will understand that various omissions, modifications, substitutions and changes in the forms and details of the device illustrated and in its operation maybe made without departing in any way from the spirit of the present invention. No feature of the invention is critical or essential unless it is expressly stated as being "critical" or "essential."

BRIEF SUMMARY

The present invention provides an improved cigar or shell for fabricating and making custom made cigars, and a method of making such cigars or shells that includes preferably tobacco, preferably tobacco leaves.

The method of the present invention thus enables an end user that purchases the packaged cigars or shells to make his or her own cigars with a selected, custom tobacco filler material. The method preferably includes the use of a liquid that includes flavor or flavoring. The liquid can be, in whole or in part, water, alcohol, solvent, oil, propylene glycol, ethyl alcohol, glycerin, benzyl alcohol as examples. The liquid can be flavored with a flavor such as for example vanilla, honey, berry, chocolate, peach, champagne, cognac, and/or menthol.

With the method of the present invention, the cigar or shell that is formed preferably has a generally cylindrical shape. In a preferred embodiment, a sheet can be single or multiple layered and comprised entirely of tobacco leaves, or can be a combination of tobacco leaves and other material, which are preferably combustible material(s).

In an alternative embodiment one or more intermediate sheets with one or more tobacco sheets can be rolled into a cigar tube or shell to resist the loss of moisture and increase shelf life.

The flavors are preferably added to either the shaped tube (or the sheet of material that includes tobacco) with a liquid. This flavored liquid is typically applied to the tobacco sheet or to the shaped tube at levels of between about 0.01 to 45% by weight, and preferably between about 0.1% to 10% by weight. This flavored liquid is typically applied to the sheet of material that includes tobacco (or to the shaped tube) with a carrier liquid such as ethyl alcohol, propylene glycol, water or the like. Glycerin and invert sugar can also be used as a carrier. Some humectants can also be used, however, little or no humectants can be used. In general terms, the flavors can be provided by botanical extracts, essential oils, or artificial flavor chemicals, any one of which or a combination thereof mixed with a carrying solvent such as propylene glycol, ethyl alcohol, glycerin, benzyl alcohol, or other alcohol, for example. Other flavors can include cocoa, licorice, coffee, vanilla or other botanical extracts. Essentials oils can be used such as wine essence, cognac oil, rose oil, mate or other oils.

BRIEF DESCRIPTION OF THE DRAWINGS

Reference will now be made to the drawings, wherein like parts are designated by like numerals, and wherein.

DETAILED DESCRIPTION OF AT LEAST ONE PREFERRED EMBODIMENT

Detailed descriptions of one or more preferred embodiments are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in any appropriate system, structure or manner.

Figure 1:
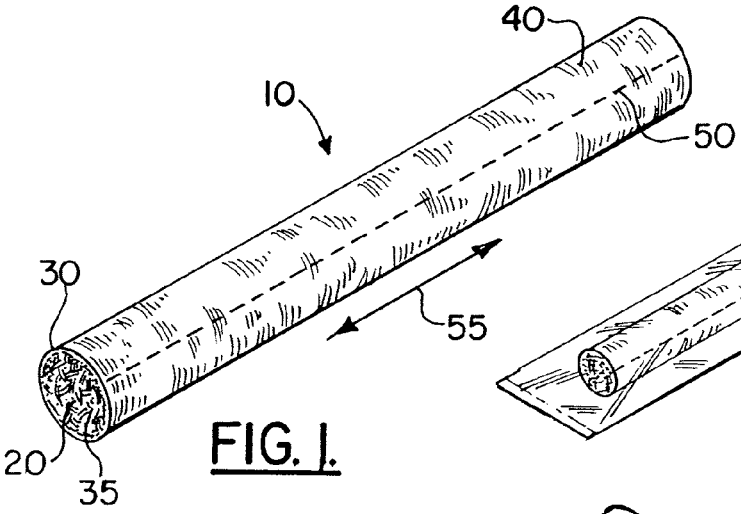
FIG. 1 is a perspective view of a preferred embodiment showing perforations along a longitudinal line of a cigar.
Figure 1A:
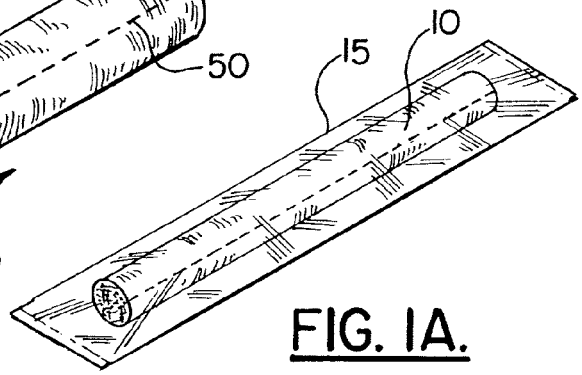
FIG. 1A is a perspective view of the cigar in FIG. 1 packaged with a wrapper.

Reference will now be made to the drawings, wherein like parts are designated by like numerals, and wherein. FIG. 1 is a perspective view of a preferred embodiment showing perforations along a longitudinal line 50 of a cigar 10. FIG. 1A is a perspective view of the cigar 10 in FIG. 1 packaged with a wrapper 15. A new cigar 10 is shown having a shell 30 with longitudinal perforation 50 and tobacco filler material 20 contained in bore 35. Cigar 10 can be placed in wrapper 50 to preserve freshness. Cigar 10 can be made in any desired length and with a predetermined diameter.

Figure 2:
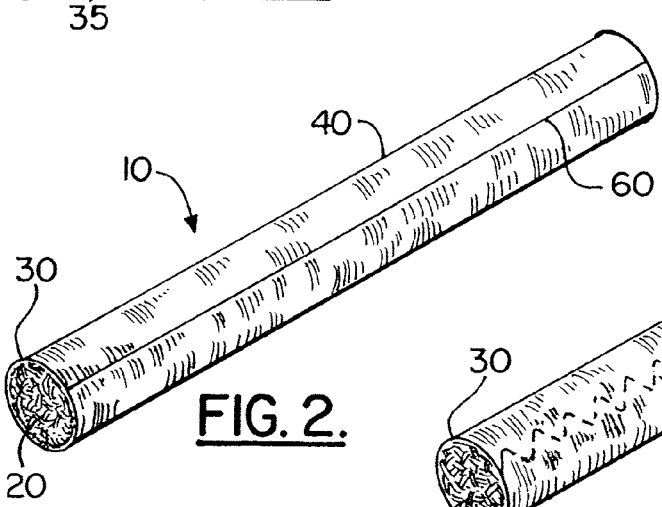
FIG. 2 is a perspective view of a preferred embodiment showing an etched or cut line along the longitudinal length of a cigar.
Figure 3:
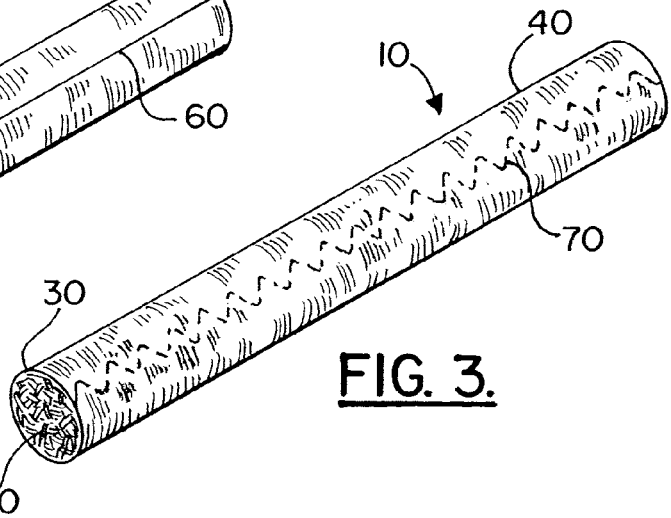
FIG. 3 is a perspective view of a preferred embodiment showing irregular perforations along the longitudinal length.

Cigar 10 can include longitudinal perforation 50 in the longitudinal direction of arrow 55. In alternative embodiments cigar 10 can include etched line 60 or irregular longitudinal perforation 70 (FIGS. 2 and 3). FIG. 2 is a perspective view of a preferred embodiment showing an etched, creased, or cut line 60 along the longitudinal length of cigar 10. FIG. 3 is a perspective view of a preferred embodiment showing irregular perforations 70 along the longitudinal length. Perforations 50, line 60, and irregular perforations 70 allow cigar 10 to be easily opened by user who wishes to replace tobacco filler material 20 with a select tobacco filler material 21. Perforations 50, 70 should be small enough so that air flow will be minimized through the perforations, but large enough to allow a user to separate the shell if desired.

Cigar 10 preferably has a serrated perforations 70. The purpose of serrating perforations 70 is to make the edges 51,52 bond better. Instead of serrations, perforations 70 could be in other shapes or patterns to enable edges 51,52 to better bond to the outside of cigar 10 when rolled.

Figure 3A:
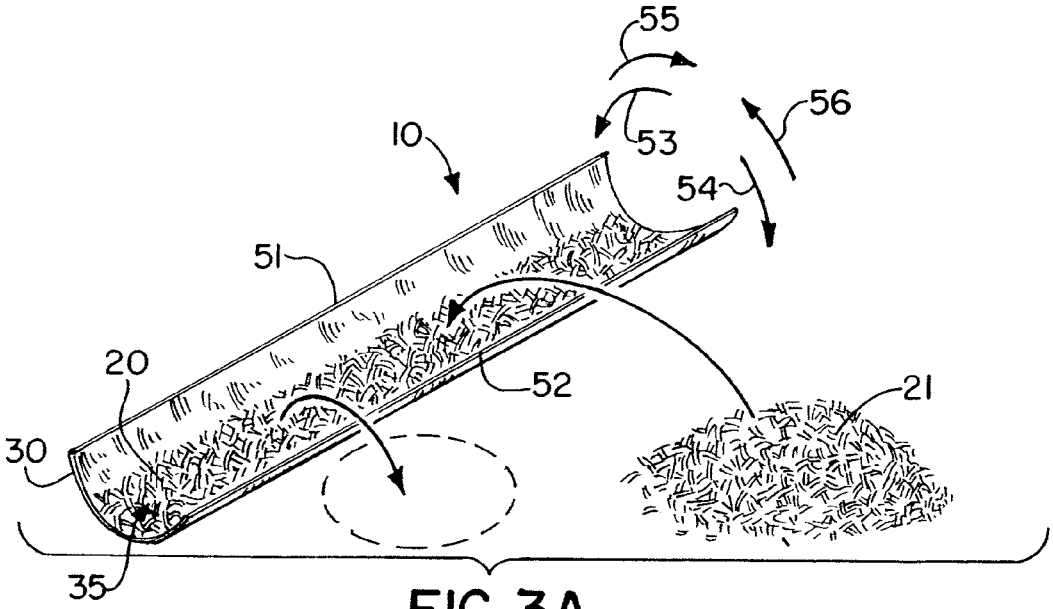
FIG. 3A is a perspective view of either the cigars of FIGS. 1 or 2 wherein edges have been opened to allow access to the interior bore of the cigar.

FIG. 3A is a perspective view of either the cigars 10 of FIGS. 1 or 2 wherein edges have been opened to allow access to the interior bore of the cigar. FIG. 3A shows cigar 10 wherein perforated line 50 has been opened creating edges 51,52 which can be moved apart in the directions of arrows 53,54 to allow access to bore 35. Tobacco filler material 20 can be removed from bore 35 and replacement tobacco filler material can be placed in bore 35 while edges 51, 52 are held apart. Edges 51,52 will have a memory wherein they will tend to roll up in the directions of arrows 55,56 allowing the user to easily make a new cigar.

Figure 4:
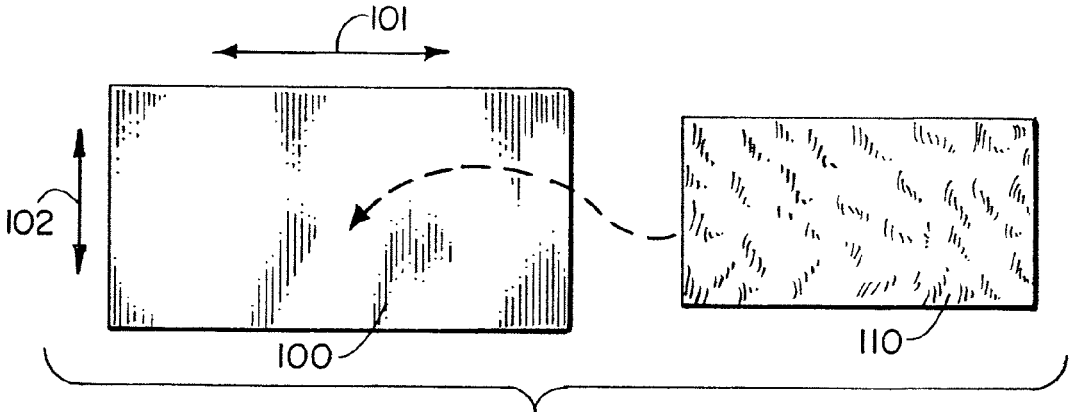
FIG. 4 shows a preferred embodiment wherein a tobacco sheet can be combined with a separating sheet.
Figure 5:
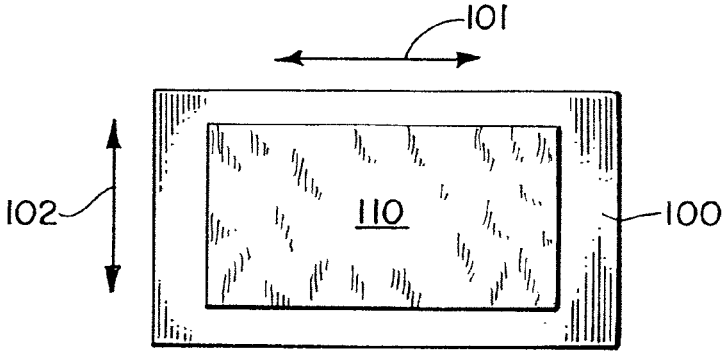
FIG. 5 shows the tobacco sheet on top of the separating sheet where the tobacco sheet is smaller in all dimensions compared to the separating sheet.
Figure 6:
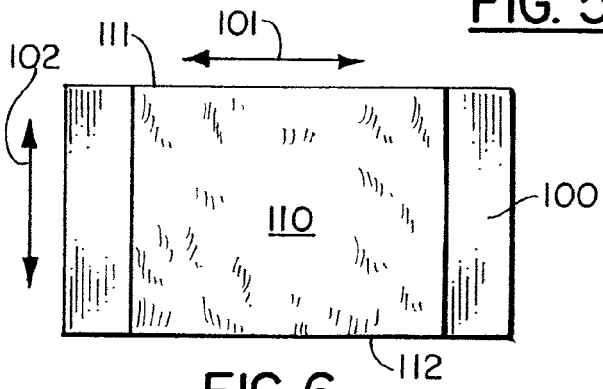
FIG. 6 shows the tobacco sheet on top of the separating sheet where the tobacco sheet is smaller in two dimensions compared to the separating sheet.

FIG. 4 shows a preferred embodiment wherein a tobacco sheet 110 can be combined with a separating sheet 100. FIG. 5 shows the tobacco sheet 110 on top of the separating sheet 100 where the tobacco sheet 110 is smaller in all dimensions (arrows 101,102) compared to the separating sheet 100. FIG. 6 shows the tobacco sheet 110 on top of the separating sheet 100 where the tobacco sheet is smaller in two dimensions (arrow 101) compared to the separating sheet 100. In an alternative embodiment a tobacco sheet 110 (which can be made from homogenized tobacco paper or natural tobacco leaves) is placed over a sealing/protecting sheet 100 (FIGS. 4-6). Sheet 110 is preferably smaller than sheet 100 in the direction of arrow 101 (FIG. 6)*and* can also be smaller in the direction of arrow 102 (FIG. 5). Sheet 100 can be plastic, cellophane, polymer, foil, wax paper, or other materials which resist moisture and air flow.

Figure 7:
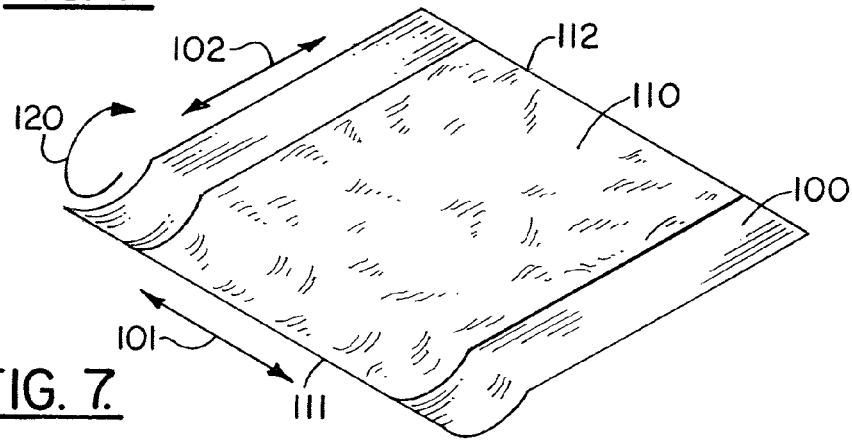
FIG. 7 is a perspective view showing the tobacco sheet and separating sheet being rolled.
Figure 8:
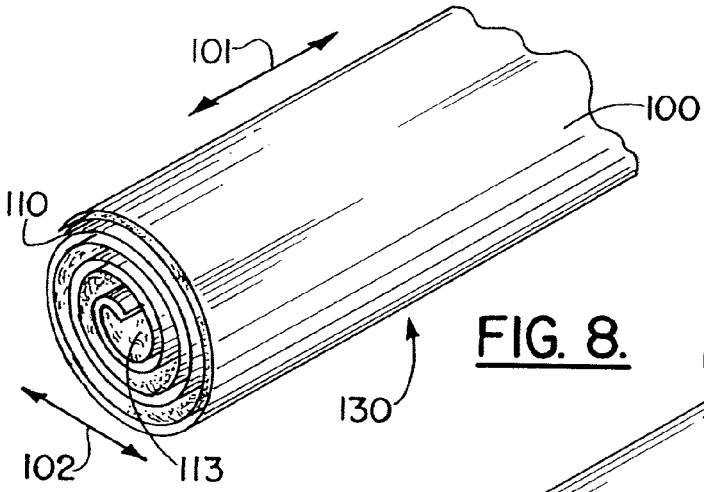
FIG. 8 is a perspective view showing a shell wherein the tobacco sheet and separating sheet have been rolled together.
Figure 9:
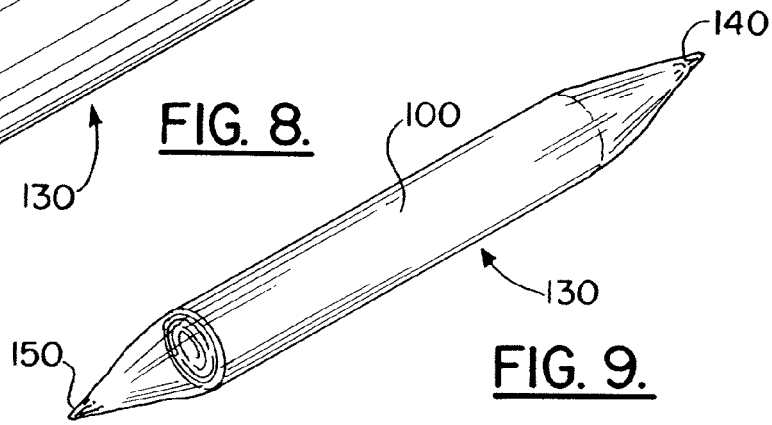
FIG. 9 is a perspective view of a rolled shell wherein the separating sheet serves as the wrapper or packaging.

FIG. 7 is a perspective view showing the tobacco sheet 110 and separating 100 sheet being rolled. FIG. 8 is a perspective view showing a shell 130 wherein the tobacco sheet 110 and separating sheet 100 have been rolled together. FIG. 9 is a perspective view of a rolled shell 130 wherein the separating sheet serves as the wrapper or packaging. As shown in FIG. 7 sheet 110 and 100 can be rolled in the direction of arrow 120 to form a shell 130 as shown in FIG. 8 having bore 113. FIG. 8 shows a shell 130 where sheet 100 and sheet 110 are the same dimension in the direction of arrow 101. FIG. 9 shows a shell 130 where sheet 100 is larger than sheet 110 in the direction of arrow 101. In FIG. 9 sheet 100 can be used as the packaging for rolled shell 130 by sealing sheet 100 on ends 140,150.

Figure 10:
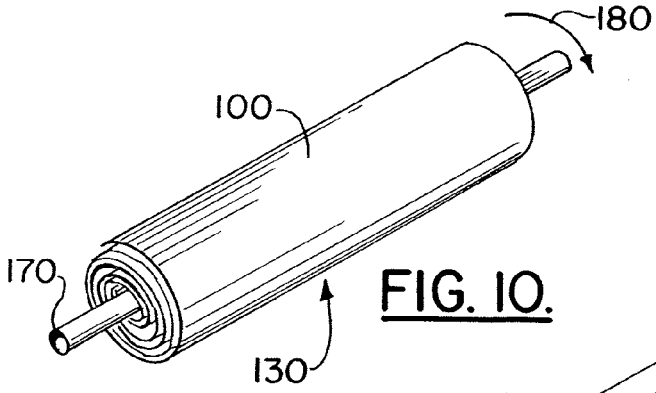
FIG. 10 is a perspective view of a rolled shell (tobacco sheet and separating sheet) and a mandrel.
Figure 10A:
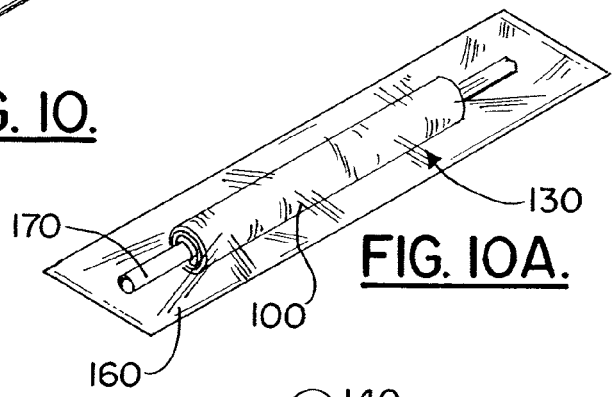
FIG. 10A is a perspective view of the rolled shell of FIG. 10 wherein the shell is wrapped or packaged.
Figure 11:
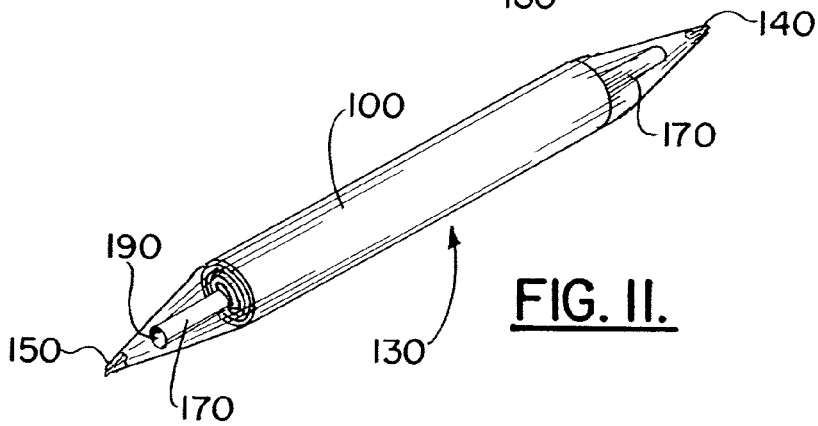
FIG. 11 is the rolled shell of FIG. 9, but also including a mandrel.

FIG. 10 is a perspective view of a rolled shell 130 (tobacco sheet 110 and separating sheet 100) and a mandrel/form casing 170. FIG. 10A is a perspective view of the rolled shell 130 of FIG. 10 wherein the shell 130 is wrapped or packaged. FIG. 11 is the rolled shell 130 of FIG. 9, but also including a mandrel 170.

Mandrel/form casing 170 can be formed from a rigid or flexible material in a form of a cylinder of a predetermined length and outer diameter. Mandrel/form casing 170 can be made either hollow, with a central opening 190, or as a solid body. It is desirable that mandrel/form casing 170 be substantially inflexible and strong enough to withstand forces applied to mandrel/form casing 170 when shell 130 is rolled.

As shown by FIG. 10 a mandrel 150 (such as a straw) can be used in the rolling process shown in FIG. 7. Additionally, shell 130 can be packaged in a separate wrapper 160 leaving mandrel 170 in place. In such a manner mandrel 170 would help keep shell 130 in a cylindrical form during shipment. FIG. 11 shows sheet 100 being used as the wrapper for shell 130 and including mandrel 170.

To use shell 130 the user merely unwraps shell 130 by cutting open ends 140,150 (FIGS. 9 and 11) or opening wrapper 160 (FIG. 10A). If mandrel 170 was used it is removed. Shell 130 is unwrapped in the direction of arrow 180 (FIG. 10) and sheet 100 is removed and discarded. Sheet 110 can now be filled with the tobacco filler material of the user's choice. Sheet 110 will have a memory which will cause it to tend to roll back up on its own. Thus the user will have an easier time in creating a custom cigar and will not need finger dexterity as required with flat sheets.

Sheet 100 is used to substantially increase the shelf life of packaged shell 130. Because shell 130 is made of tobacco when exposed to air it will tend to dry out and become brittle. Sheet 100 being wrapped about sheet 110 provides multiple layers of protection against air flow and consequent moisture loss.

The finished cigars 10 or shells 130 can be packaged in conventional containers and sold directly to customers who desire to roll their own cigars, but do not have the required finger dexterity. An ultimate user will remove the cigar 10 or shell 130 from its outer wrapper 15, 160 and prying the cigar 10 or shell 130 open by forcing it open. For the cigar all or part of the tobacco filler material 35 can be discarded. Because cigar 10 or shell 130 is pre-rolled, it has a "memory" and will attempt to again assume a cylindrical or spiral shape. The user will then fill the bore 35 with any desired blend of the favorite tobacco and seal edges 51,52 by applying a small amount of moisture to the edges 51,52 and bringing the edges 51,52 together. A small amount of pressure may be applied to the edges 51,52 to cause them to seal them together. For the shell 130 user will then fill the bore 113 with any desired blend of the favorite tobacco and seal edges 111,112 by applying a small amount of moisture to the edges 111,112 and bringing the edges 111, 112 together. In this manner, a custom-tailored cigar is made, answering all requirements of a connoisseur as to the tobacco blend, size and length of a cigar.

In FIGS. 4-11, sheet 110 can be, for example, generally rectangular or square in shape. Other shapes for the sheet 110 can be provided such as, for example, triangular, trapezoidal, circular or oval. Sheet 110 preferably includes tobacco, and preferably tobacco leaves. Sheet 110 preferably comprises a laminated composite of two layers, one inner layer 114 preferably made of homogenized tobacco material and the other outer layer 115 preferably made of tobacco leaf material, inner layer 114 and outer layer 115 preferably bonded together with cigar glue. Preferably, the outer layer 115 extends beyond the inner layer to provide for better adhesion of edges 111,112 when rolled. The homogenized tobacco material of inner layer 114 can be reconstituted tobacco sheet material commercially available from Nuway of Conn. Outside layer 115 can be tobacco leaf material commercially available from Nuway of Conn.

Alternatively, inner layer 114 can be reconstituted tobacco binder material, and outer layer 115 can be reconstituted tobacco wrapper material. In the alternative, inner layer 114 can be reconstituted tobacco binder material, and outer layer 115 can be tobacco leaves bonded thereto. Sheet 110 can be a single layer, in which case it is preferably made of tobacco leaf material, though it can be made of homogenized tobacco material.

As part of the method, the cigar 10 or sheet 110 can be sprayed with a liquid that preferably includes a flavoring.

Figure 12:
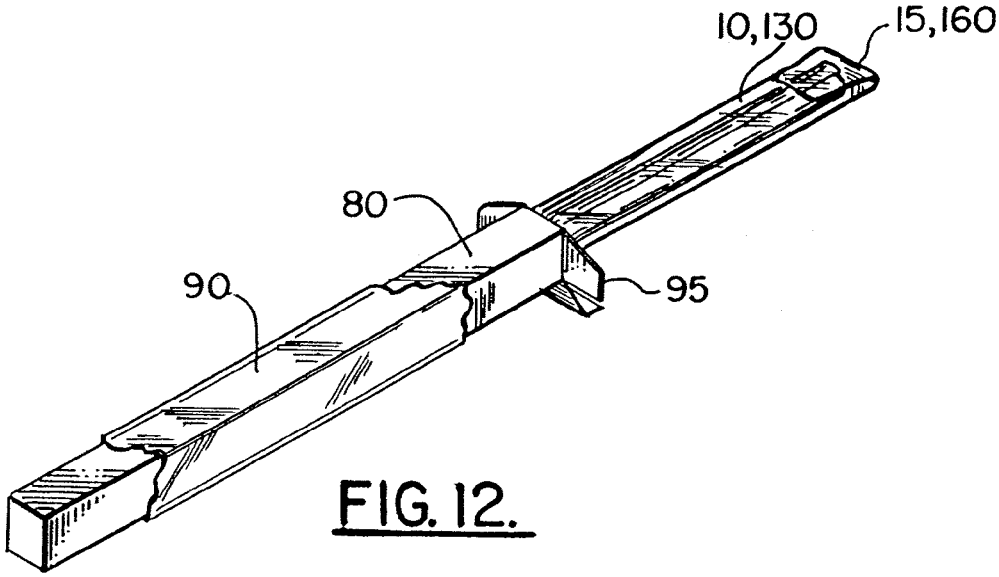
FIG. 12 is a perspective, partial cross-sectional view of a single cigar or shell and a wrapper being boxed with the shell partially pulled from the box and the box itself being wrapped.

Cigars 10 or shells 130 can be packaged in any appropriate manner. FIGS. 12 through 15 show various examples of packaging. FIG. 12 is a perspective, partial cross-sectional view of a single cigar 10 or shell 130 and a wrapper 15,160 being boxed with the shell partially pulled from the box and the box itself being wrapped. This figure shows packaging that can be used for any embodiment disclosed in this application. Cigar 10 or shell 130 is shown covered in wrapper 15,160 which are both enclosed in box 80. Box 80 can itself be covered by wrapper 90. Flap 95 encases cigar 10 or shell 130 and wrapper 15,160 in box 80.

Figure 13:
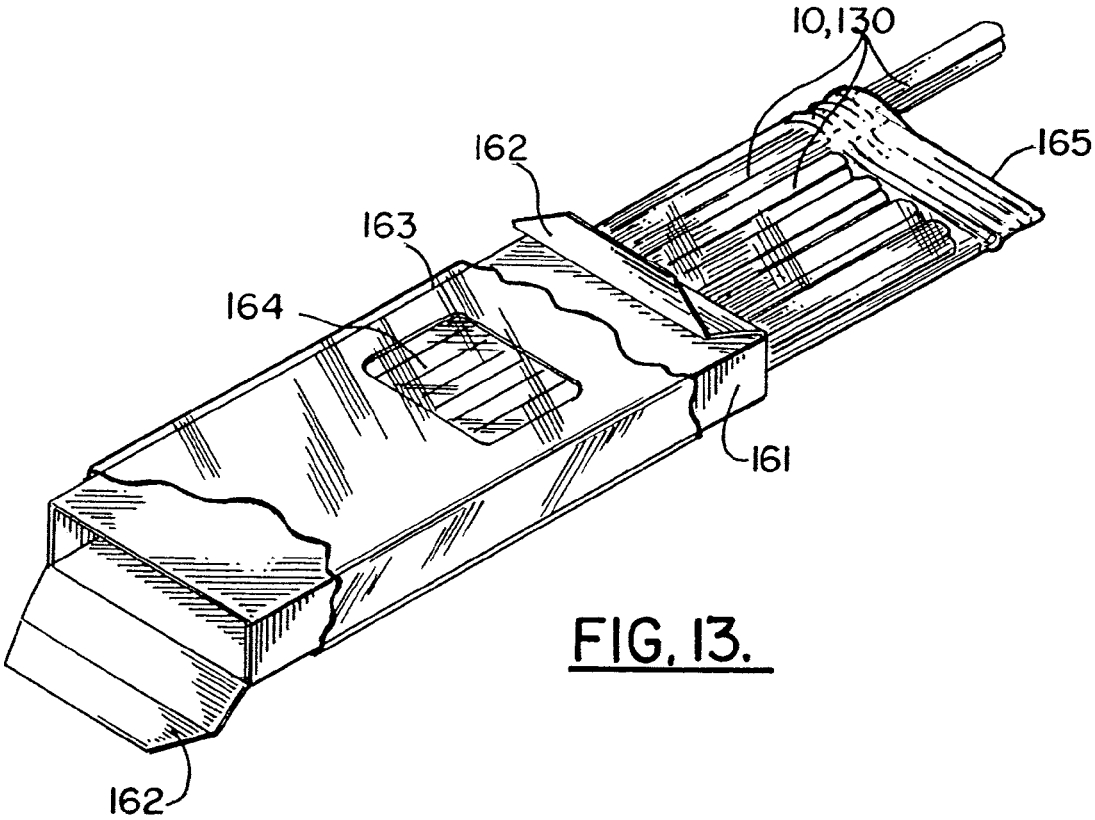
FIG. 13 is a perspective, partial cross-sectional view of multiple cigars or shells in a single zip-wrapper all of which being boxed and with the zip-wrapper partially pulled from the box with one cigar or shell partially pulled from the zip wrapper and the box itself being wrapped.

FIG. 13 is a perspective, partial cross-sectional view of multiple cigars 10 or shells 130 in a single zip-wrapper 165 all of which being boxed and with the zip-wrapper 165 partially pulled from the box 161 with one cigar 10 or shell 130 partially pulled from the zip wrapper 165 and the box 161 itself being wrapped. This figure also shows packaging that can be used for any embodiment disclosed in this application. The cigars 10 or shells 130 and zip-wrapper 165 can be enclosed in box 161. Box 161 can itself be covered by wrapper 163 and include window 164 for viewing the cigars 10 or shells 130. Flaps 162 close respective ends of box 161.

Figure 14:
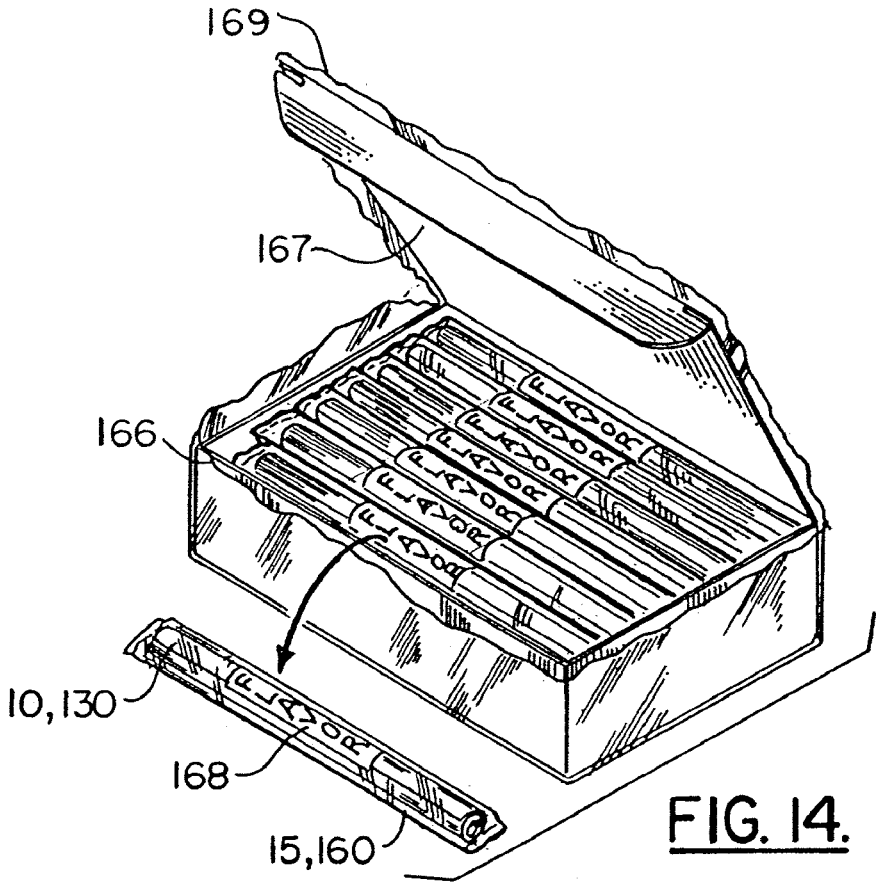
FIG. 14 is a perspective view of multiple cigars or shells individually wrapped and placed in a sing carton opening at the top through lid.

FIG. 14 is a perspective view of multiple cigars 10 or shells 130 individually wrapped and placed in a sing carton 166 opening at the top through lid 167. The cigars 10 or shells 130 are individually packaged in wrappers 15,160 and wrappers 15,160 can have indicia 168 which provides consumers with information concerning the cigars 10 or shells 130, such as flavoring or other information. Carton 166 can itself be covered by wrapper 169.

Figure 15:
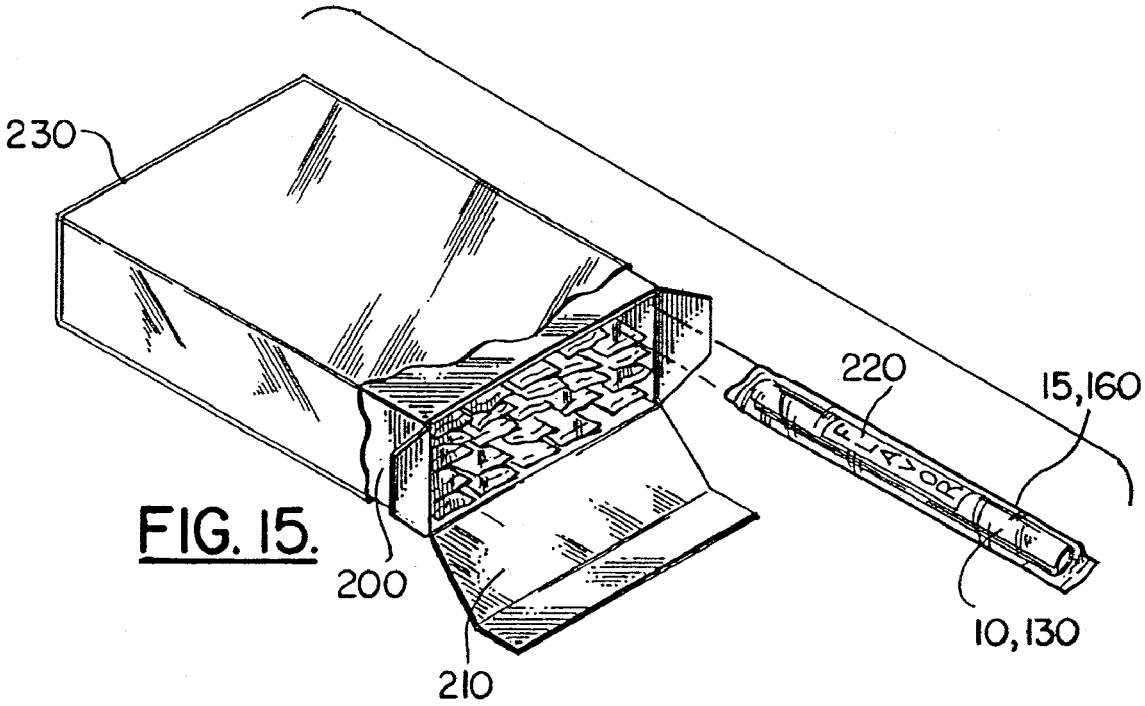
FIG. 15 is a perspective view of multiple cigars or shells individually wrapped and placed in a single carton opening at the side through lid.

FIG. 15 is a perspective view of multiple cigars 10 or shells 130 individually wrapped and placed in a single carton 200 opening at the side through lid 210. The cigars 10 or shells 130 are individually packaged in wrapper 15,160 and wrapper 15,160 can include indicia 220 which provides consumers with information such as flavoring or other information. Carton 200 can itself be covered by wrapper 230.

Figure 16:
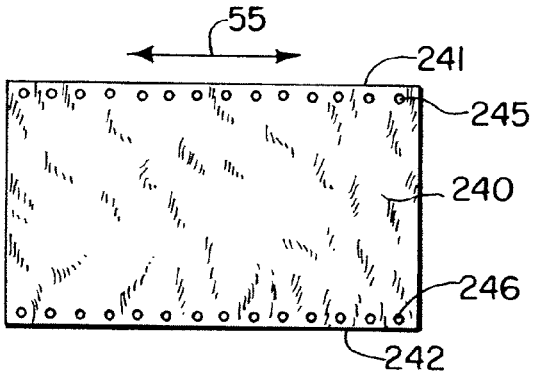
FIG. 16 is a top view of an alternative sheet.
Figure 17:
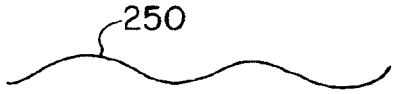
FIG. 17 is a top view of a tie which can be used with the sheet of FIG. 16.
Figure 18:
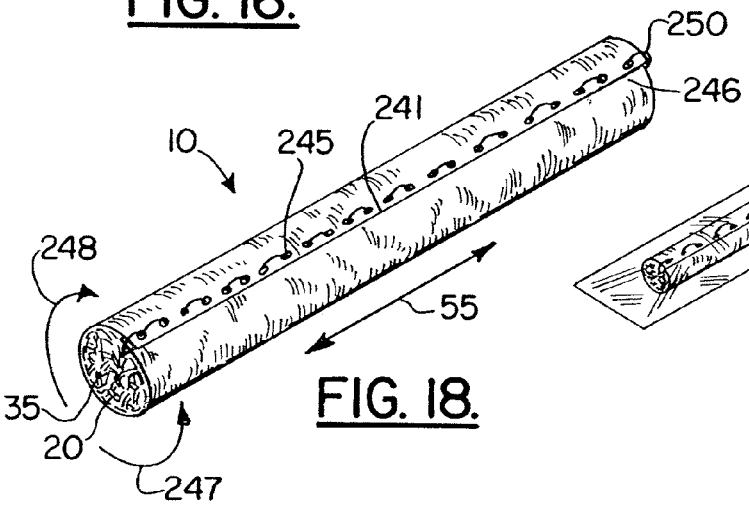
FIG. 18 is a perspective view of a cigar formed from the sheet of FIG. 16.
Figure 19:
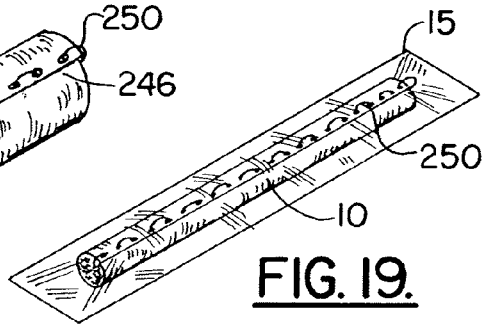
FIG. 19 is a perspective view of the cigar of FIG. 18 packaged with a wrapper.

FIG. 16 is a top view of an alternative sheet 240. Sheet 240 can include a plurality of openings 245,246 respectively located on edges 241,242. FIG. 17 is a top view of a tie 250 which can be used with sheet 240. FIG. 18 is a perspective view of a cigar 10 formed from sheet 240 and tie 250. Bore 35 of cigar 10 can be filled with tobacco filler material 20. Tie 250 can be threaded through openings 245,246 to hold cigar 10 in a cylindrical shape. Alternatively openings 245,245 can be formed after sheet 240 has been rolled into a cylindrical shape and filled with tobacco filler material 20. Openings 245,246 can be formed at the same time tie 250 is inserted into the openings, such as by stitching with a sewing machine. Tie is shown relatively loose but can be as tight as desired causing edges 241,242 to touch. FIG. 19 is a perspective view of the cigar 10 of FIG. 18 packaged with a wrapper 15.

When a user desires to insert his tobacco fill material of choice, tie 250 can be cut or untied from openings 245,246 and edges 241,242 can be pulled apart providing access to bore 35. Tobacco filler material 20 can be removed from bore 35 and replacement tobacco filler material can be placed in bore 35 while edges 241,242 are held apart. Edges 241,242 will have a memory wherein they will tend to roll up in the directions of arrows 247,248 allowing the user to easily make a new cigar.

Figure 20:
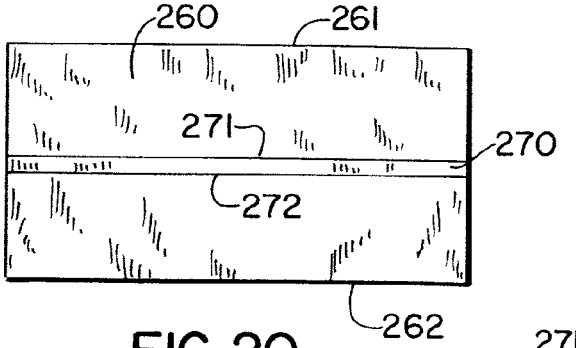
FIG. 20 is a top view of a an alternative sheet.
Figure 21:
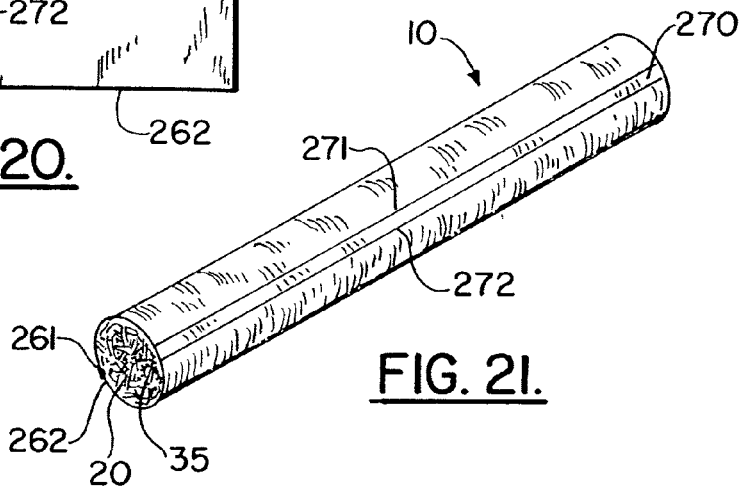
FIG. 21 is a perspective view of a cigar formed from the sheet of FIG. 20.

FIG. 20 is a top view of a an alternative sheet 260 showing an area 270 which can be easily separate when desired. FIG. 21 is a perspective view of a cigar 10 formed from sheet 260 where edges 261,261 have been attached and bore 35 has been filled with tobacco filler material 20. Area 270 can be formed by causing it to be of less thickness than the remaining portion of sheet 260. For example, were sheet 260 to be formed from a layer of binder and a layer of wrapper, area 270 may be formed by removing the binder or removing the wrapper thereby making it weaker than the remaining part of sheet 260. Various other processes can be applied to area 270 to make it weaker than the remainder of sheet 260—such as scarring, scratching, etching etc. Where stress is applied to area 270 sheet 360 will separate along area 270 and into edges 271, 272. During the manufacturing process of cigar 10 edges 261,262 were overlapped and sealed and are not easily separable. Selected tobacco filler material can then be placed in bore 35 and a custom cigar made by the user.

Figure 22A:
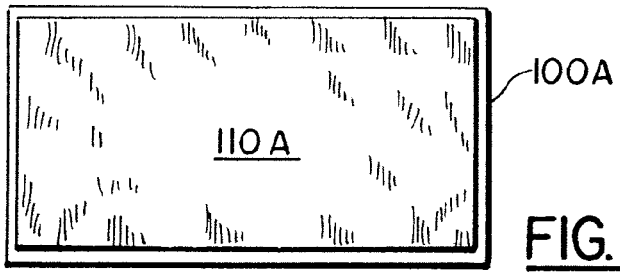
FIGS. 22A through 22C show the individual tobacco sheets and separating sheets of FIG. 22.
Figure 22B:
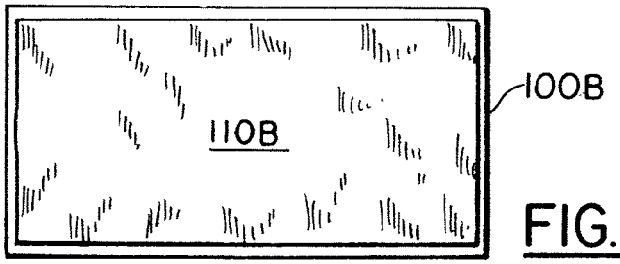
Figure 22C:
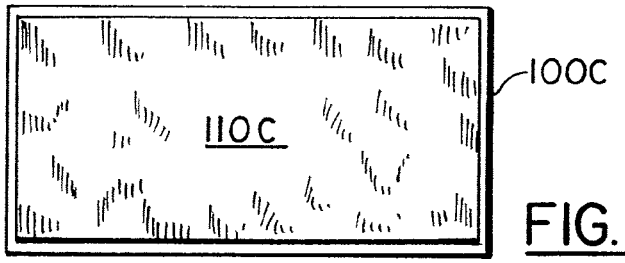
Figure 22:
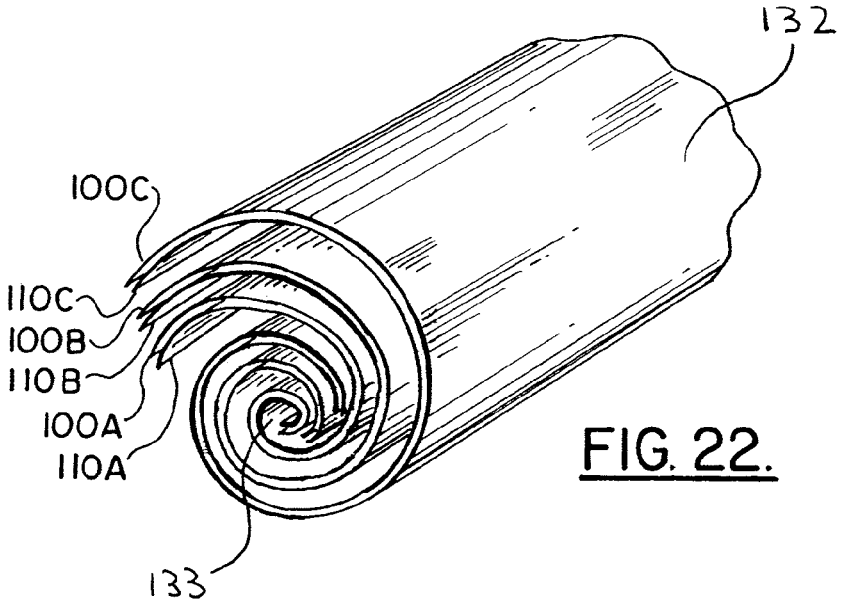
FIG. 22 is shows an alternative embodiment having multiple tobacco sheets along with multiple separating sheets.

FIGS. 22A through 22C show an alternative embodiment having multiple tobacco sheets 110A, 110B, 110C along with multiple separating sheets 100A, 100B, 100C, placed together and forming multiple sheet rolled shell 132. As shown in FIG. 22, multiple tobacco sheets 110A, 110B, 110C can be combined with multiple separating sheets 110A, 100B, 100C to form shell 132 having bore 133. The tobacco sheets 110 and separating sheets 100 can be stacked in an alternating manner and rolled into a rolled shell 132. Shell 132 can then be encased in a wrapper/packaging 15. Alternatively, additional tobacco sheets 110 (e.g., four or more) can be used forming multiple sheet rolled shell 132. Also alternatively, merely two tobacco sheets 110A, 110B can be used forming multiple sheet rolled shell 132. Also alternatively, a smaller number of separating sheets 100 can be used than the number of tobacco sheets 110. For example, in one embodiment only an outer separating sheet 110C is used with multiple tobacco sheets 110A, 110B, 110C. As another example, only an inner separating sheet 100A is used with multiple tobacco sheets 110A, 110B, 110C. As another example, alternating separating sheets 100A, 100C are used with multiple tobacco sheets 110A, 110B, 110C. Also alternatively, more separating sheets 100 can be used than tobacco sheets 110. Additionally, more or less than three tobacco sheets 110 can be used. Alternatively, similar to the embodiments shown in FIGS. 9 and 11, separating sheets 100A, 100B, and/or 100C can be used as the wrapper/packaging (either all separating sheets 100 or a portion of all separating sheets 100). Additionally, with any of these embodiments rolled, shell 132 (e.g., tobacco sheets 110A, 110B, 110C and separating sheets 100A, 100B, 100C) can include a mandrel/form casing 170. Mandrel/form casing 170 can assist rolled shell 132 in maintaining its shape after being packaged.

In another alternative embodiment, tobacco sheet 110A and separating sheet 100A are first rolled into rolled shell 130 and then tobacco sheet 110B and separating sheet 100B are then rolled over shell 130 to form rolled shell 132. Alternatively, multiple rolled shells can be formed in this manner with alternating tobacco sheets 110 and separating sheets 100. The order of tobacco sheets 110 and separating sheets can be varied, such as having inner tobacco sheets 110 and outer separating sheets 100; or inner separating sheets 100 and outer tobacco sheets 110. Alternatively, one or more separating sheets 100 can be omitting from rolled shell 132.

Those skilled in the art will understand that various materials for wrapping can be used to enclosed the tubes or shells. These include, but are not limited to, Low & High Density Polyethylene with EVA additive, Linear Low Density Poly, Polypropylene, Orientated Polypropylene, Cast Polypropylene, PVC, Polyester, Vaper Barrier packaging, Moisture Barrier packaging, Laminated packaging, Shrink film, Stretch Film, Foil Films (which can be translucent or opaque), Metalized Film, Cellophane, and Polyethylene Terephthalat. In addition to an "EVA" additive a barrier foil lamination can be used being either coated or metallized. The packaging of the present invention, whether plastic, aluminum, or glass, keeps moisture in or dramatically slows down moisture loss from the tubes or shells. It is preferable that the wrapping material have adequate moisture resistant properties so that the tubes or shells do not dry out before use by consumers.

REFERENCE NUMERAL LIST

| REFERENCE NO. | DESCRIPTION |
|---|---|
| 10 | cigar |
| 15 | wrapper/packaging |
| 20 | tobacco filler material |
| 21 | tobacco filler material |
| 30 | shell |
| 35 | bore |
| 50 | perforations |
| 51 | edge |
| 52 | edge |
| 53 | arrow |
| 54 | arrow |
| 55 | arrow |
| 56 | arrow |
| 60 | line |
| 70 | perforations |
| 80 | box |
| 90 | wrapper |
| 95 | flap |
| 100 | separating sheet |
| 101 | arrow |
| 110 | tobacco sheet |
| 111 | edge |
| 112 | edge |
| 113 | bore |
| 114 | inner layer |
| 115 | outer layer |
| 120 | arrow |
| 130 | shell |
| 132 | shell |
| 134 | arrow |
| 140 | end |
| 150 | end |
| 160 | wrapper |
| 161 | box |
| 162 | flap |
| 163 | wrapper |
| 164 | window |
| 165 | wrapper |
| 166 | carton |
| 167 | lid |
| 168 | indicia |
| 169 | wrapper |
| 170 | mandrel |
| 180 | arrow |
| 190 | opening |
| 200 | carton |
| 210 | lid |
| 220 | indicia |
| 230 | wrapper |
| 240 | sheet |
| 241 | edge |
| 242 | edge |

-continued

REFERENCE NUMERAL LIST

| REFERENCE NO. | DESCRIPTION |
|---|---|
| 245 | openings |
| 246 | openings |
| 247 | arrow |
| 248 | arrow |
| 250 | cord/string/thread/tie |
| 260 | sheet |
| 261 | edge |
| 262 | edge |
| 270 | area |
| 271 | edge |
| 272 | edge |

It will be understood that each of the elements described above, or two or more together may also find a useful application in other types of methods differing from the type described above. Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention set forth in the appended claims. The foregoing embodiments are presented by way of example only; the scope of the present invention is to be limited only by the following claims.

The invention claimed is:

1. A method of making a custom made cigar comprising the steps of:

(a) a consumer purchasing a packaged and tobacco filled cigar having a shell in the form of a continuous wall tube, the shell having first and second ends and a longitudinal bore, the bore being filled with tobacco filler;

(i) a plurality of perforations on the shell wall which can be opened causing the cigar to have first and second longitudinal edge portions;

(ii) wherein the cigar is packaged for sale before the purchasing step and the shell wall has not been torn at the perforations;

(iii) wherein after the cigar is removed from the packaging, the perforations can be opened by a consumer, and the first and second edge portions can be moved apart thereby allowing the consumer to remove at least part of the tobacco filler from the bore, and add new tobacco to the bore and thereafter form a custom cigar;

(b) the consumer removing the cigar from the packaging that envelopes the cigar and tearing the shell wall at the perforations forming first and second edge portions, and moving apart the first and second edge portions to access to the tobacco filler in the bore;

(c) the consumer removing at least part of the tobacco filler from the bore; and (d) the consumer adding new tobacco to the bore, sealing the shell, thereby forming a custom-tailored cigar.

2. The method of claim 1, wherein in step "c" all of the tobacco filler is removed from the bore.

3. The method of claim 1, wherein in step "a" the shell is comprised of homogenized tobacco paper.

4. The method of claim 1, wherein in step "a" the shell is comprised of natural tobacco leaves.

5. The method of claim 1, wherein in step "a" the plurality of perforations are in a straight line across the longitudinal length of the bore.

6. The method of claim 1, wherein in step "a" the plurality of perforations form an irregular shape.

7. The method of claim 1, wherein in step "a" the plurality of perforations form an zig zag shape.

8. The method of claim 1, wherein in step "a" the plurality of perforations allow the cigar to be easily opened.

9. The method of claim 1, wherein in step "a" the plurality of perforations are small enough so that air flow through the perforations is minimized, but large enough to allow a consumer to separate the perforations.

10. The method of claim 1, wherein in step "a" the cigar is packaged for sale as a single cigar in a wrapper.

11. The method of claim 1, wherein in step "a" the cigar is packaged for sale in a multiple cigar zip-wrapper packaging.

* * * * *